US009631523B2

(12) United States Patent
Eppinger et al.

(10) Patent No.: US 9,631,523 B2
(45) **Date of Patent: *Apr. 25, 2017**

(54) INTERNAL COMBUSTION ENGINE VALVE TRAIN ADJUSTMENT DEVICE

(71) Applicant: Daimler AG, Stuttgart (DE)

(72) Inventors: Matthias Eppinger, Neuenhagen (DE); Kai Lehmann, Ludwigsfelde (DE); Marc Maronde, Berlin (DE); Bernd Neubauer, Schwieberdingen (DE); Tilmann Roemheld, Waiblingen (DE); Thomas Stolk, Kirchheim (DE); Alexander Von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 33 days.

This patent is subject to a terminal disclaimer.

(21) Appl. No.: 14/383,225

(22) PCT Filed: Jan. 29, 2013

(86) PCT No.: PCT/EP2013/000265

§ 371 (c)(1),
(2) Date: Sep. 5, 2014

(87) PCT Pub. No.: WO2013/131602

PCT Pub. Date: Sep. 12, 2013

(65) Prior Publication Data

US 2015/0047588 A1 Feb. 19, 2015

(30) Foreign Application Priority Data

Mar. 8, 2012 (DE) ..... 10 2012 004 420

(51) Int. Cl.
*F01L 1/34* (2006.01)
*F01L 1/344* (2006.01)
(Continued)

(52) U.S. Cl.
CPC ..... *F01L 1/34413* (2013.01); *F01L 13/0036* (2013.01); *F02B 75/20* (2013.01); *F02B 75/22* (2013.01); *F01L 2013/0052* (2013.01)

(58) Field of Classification Search
CPC ..... F01L 1/34413; F01L 13/0036; F01L 2013/0052; F02B 75/20; F02B 75/22
(Continued)

(56) References Cited

U.S. PATENT DOCUMENTS 7,472,671 B2 * 1/2009 Elendt ..... F01L 1/053 123/90.16
8,474,424 B2 * 7/2013 Meintschel ..... F01L 13/0036 123/90.18
(Continued)

FOREIGN PATENT DOCUMENTS

CN 102066704 A 5/2011
DE 10 2005 006 489 A1 8/2006
(Continued)

OTHER PUBLICATIONS

Corresponding International Search Report dated Jun. 7, 2013 with English Translation (four (4) pages).
(Continued)

*Primary Examiner* — Ching Chang
(74) *Attorney, Agent, or Firm* — Crowell & Moring LLP

(57) ABSTRACT

A device for adjusting a motor vehicle valve train includes at least one camshaft with at least four cam elements arranged in an axially displaceable manner. In each case two of the cam elements that are adjacently situated are formed as a cam element group to be switched together.

14 Claims, 1 Drawing Sheet

Figure 1:
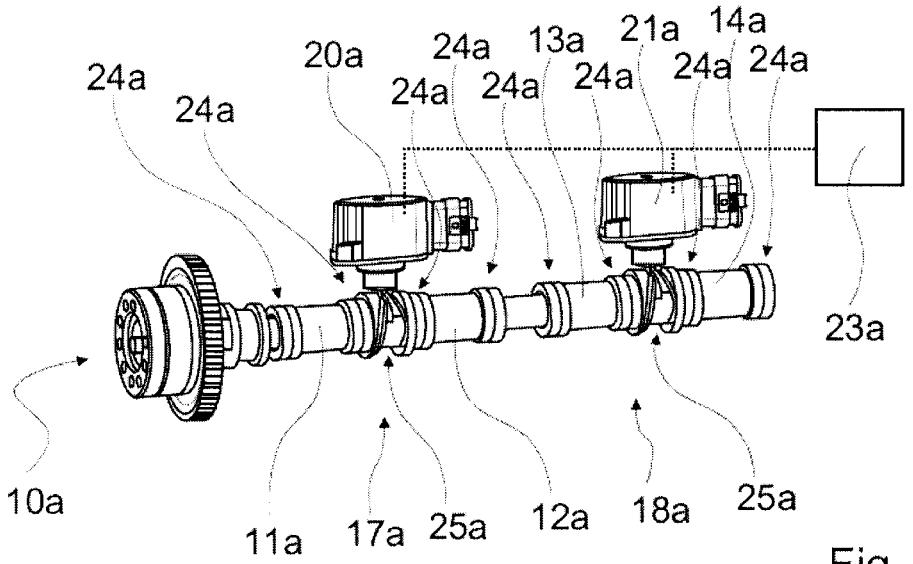

(51) Int. Cl.

| | |
|---|---|
| ***F01L 13/00*** | (2006.01) |
| ***F02B 75/20*** | (2006.01) |
| ***F02B 75/22*** | (2006.01) |

(58) Field of Classification Search
USPC ..... 123/90.18, 90.16
See application file for complete search history.

(56) References Cited

U.S. PATENT DOCUMENTS

| | | | |
|---|---|---|---|
| 2011/0079188 | A1 | 4/2011 | Meintschel et al. |
| 2012/0138000 | A1 | 6/2012 | Schaedel et al. |

FOREIGN PATENT DOCUMENTS

| | | | |
|---|---|---|---|
| DE | 10 2007 010 156 | A1 | 9/2008 |
| DE | 10 2008 029 325 | A1 | 12/2009 |
| DE | 10 2009 034 990 | A1 | 2/2011 |
| JP | 61-57110 | U | 4/1986 |
| JP | 2009-180142 | A | 8/2009 |
| JP | 2009-228543 | A | 10/2009 |

OTHER PUBLICATIONS

Corresponding German Language Written Opinion dated Jun. 7, 2013 (five (5) pages).
Partial English translation of Japanese Office Action mailed Aug. 4, 2015 (Three (3) pages).
English translation of Chinese Office Action issued in counterpart Chinese Application No. 201380012690.6 dated Feb. 6, 2016 (four pages).

* cited by examiner

INTERNAL COMBUSTION ENGINE VALVE TRAIN ADJUSTMENT DEVICE

BACKGROUND AND SUMMARY OF THE INVENTION

Exemplary embodiments of the invention relate to a device for adjusting a motor vehicle valve train.

German patent document DE 10 2005 006 489 A1 discloses a device for adjusting a motor vehicle valve train, having at least one camshaft which includes at least four cam elements arranged in an axially displaceable manner.

Exemplary embodiments of the present invention are directed to a particularly advantageous variable device for adjusting a motor vehicle valve train. Specifically, exemplary embodiments of the invention are directed to a device for adjusting a motor vehicle valve train, having at least one camshaft which includes at least four cam elements arranged in an axially displaceable manner.

In accordance with the invention in each case two of the cam elements that are adjacently situated are formed as a cam element group to be switched together. The cam elements may thus be switched in a particularly advantageous manner, and in particular the device for adjusting a motor vehicle valve train may have a particularly variable design. A "camshaft" is understood in particular to mean a shaft that is provided for activating multiple valves of an internal combustion engine and for activating one valve of at least one cam track in each case. It is also conceivable for the camshaft to be designed as an intake camshaft and provided for activating intake valves, or also for the camshaft to be designed as an exhaust camshaft and provided for activating exhaust valves. A "cam element" is understood in particular to mean an element mounted on a camshaft in a rotationally fixed manner, and which, for activating a valve, is provided for directly or indirectly acting on the valve in question with at least one lift. The term "in a rotationally fixed manner" is understood in particular to mean a connection that transmits a torque and/or a rotational motion unchanged. The term "axial" is understood in particular to mean axial in relation to a main axis of rotation of the cam element. The term "axially displaceable" is understood in particular to mean that the cam element is displaceable on the camshaft, parallel to the main axis of rotation of the cam element, between at least two switching positions. In the present context, the term "adjacently situated" is understood in particular to mean that the cam elements adjoin one another in the axial direction, and in particular no element, in particular no other cam element, is located between the adjacently situated cam elements. A "cam element group" is understood in particular to mean a grouping of two cam elements which are switchable together, the two cam elements being designed as two separate, independently formed components. The cam elements of a cam element group are in particular movable relative to one another in the axial direction of the camshaft in at least one operating state. The term "to be switched together" is understood in particular to mean that the two cam elements are always switched together by means of an activation, whereby an actual axial displacement of the cam elements may take place in a staggered manner.

It is further disclosed that the two cam element groups are switchable independently of one another. The cam elements may thus be switched in a particularly advantageous manner, and the device for adjusting a motor vehicle valve train may have a particularly variable design. The term "switchable independently of one another" is understood in particular to mean that a cam element group remains uninfluenced by switching of another cam element group.

It is further disclosed that the device for adjusting a motor vehicle valve train has an actuator device that in each case is associated with one of the cam element groups and which couples the two particular cam elements of the cam element group to one another during a switchover operation. The two cam element groups may thus be switched independently of one another in a particularly simple manner. An "actuator device" is understood in particular to mean a device that provides a force for switching the cam elements in order to switch the cam elements from one switching position into another switching position, and for this purpose the cam elements preferably have at least one actuator. The term "couple" is understood in particular to mean that in the switchover operation, the two cam elements of a cam element group undergo a defined movement with respect to one another due to engagement of the actuator device, and/or that a switching element of the actuator device, in particular a switch pin, is guided by a gate track of one of the cam elements directly into a gate track of the other cam element.

It is further disclosed that the two cam element groups are provided for activating valves of a four-cylinder in-line engine or of one line of an eight-cylinder V engine. The activation of valves of a four-cylinder in-line engine may thus take place in a particularly advantageous manner.

In addition, it is disclosed that the device for adjusting a motor vehicle valve train has a third cam element group, the three cam element groups being provided for activating valves of a six-cylinder in-line engine or of one line of a twelve-cylinder V engine. The activation of valves of a six-cylinder in-line engine may thus take place in a particularly advantageous manner.

Furthermore, it is disclosed that the device for adjusting a motor vehicle valve train has a control and/or regulation unit provided for operating, in at least one operating state, two cam elements of one of the cam element groups in a different switching position than the two cam elements of another of the cam element groups. Cylinders associated with the cam elements of the one cam element group may thus advantageously be operated with a different valve lift than the cylinders which are associated with the cam elements of another cam element group. A "control and/or regulation unit" is understood in particular to mean a unit having at least one control device. A "control device" is understood in particular to mean a unit having a processor unit and a memory unit, and having an operating program which is stored in the memory unit. In principle, the control and/or regulation unit may have multiple interconnected control devices which are preferably provided for communicating with one another via a bus system, in particular a CAN bus system. The term "provided" is understood in particular to mean specially programmed, designed, and/or equipped. The term "switching position of a cam element" is understood in particular to mean a defined position of the cam element which the cam element assumes after completion of a switching operation, and in which a defined cam track is engaged with the valve in question. The term "operating a different switching position" is understood in particular to mean that the cam elements of the one cam element group activate the valves associated with them with a valve lift which differs from a valve lift with which the cam elements of the other cam element group activate the valves associated with them. In this regard, the lift height and/or lift characteristic of the valve lifts may be different and/or may start in a staggered manner.

It is further disclosed that in at least one operating state, the control and/or regulation unit is provided for initially switching the cam element group whose first cam element is the next to reach its base circle phase. Switching of the cam elements may thus take place particularly quickly. A "first cam element of a cam element group" is understood in particular to mean the cam element of the two cam elements which are combined to form a cam element group, whose associated cylinder, considered starting from a firing order of the two cylinders associated with the cam elements, has an ignition point which chronologically precedes an ignition point of the cylinder which is associated with the second cam element.

Further advantages result from the following description of the drawings. Two exemplary embodiments of the invention are illustrated in the drawings. The drawings, the description, and the claims contain numerous features in combination. Those skilled in the art will also advantageously consider the features individually and combine them into further meaningful combinations.

BRIEF DESCRIPTION OF THE DRAWING FIGURES

Figure 2:
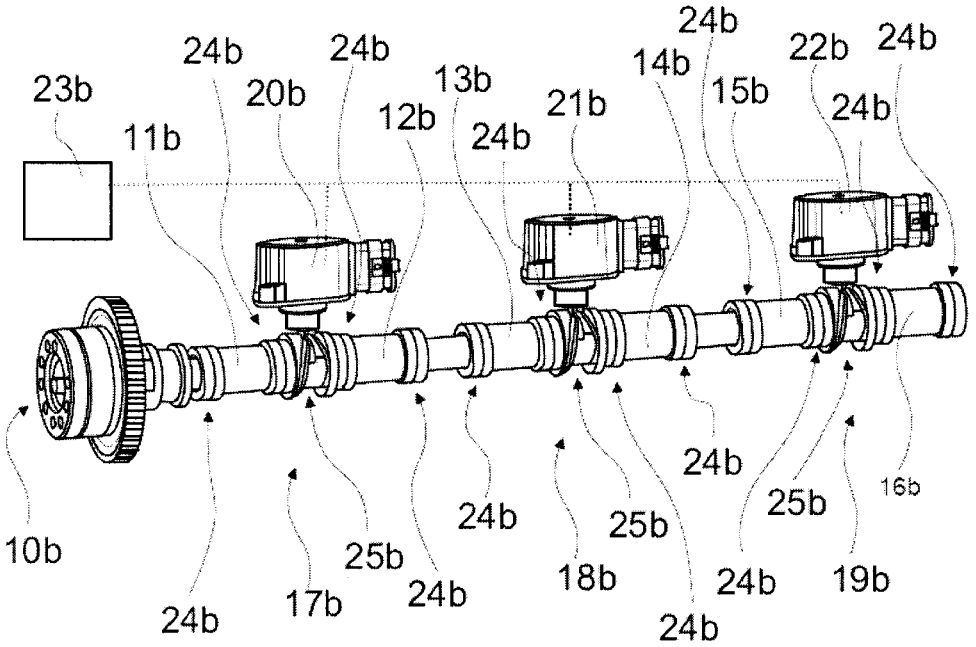

The figures show the following:

FIG. 1 a device according to the invention for adjusting a motor vehicle valve train in a first exemplary embodiment; and FIG. 2 a device according to the invention for adjusting a motor vehicle valve train in a second exemplary embodiment.

DETAILED DESCRIPTION

FIG. 1 shows a device according to the invention for adjusting a motor vehicle valve train in a first exemplary embodiment. The device for adjusting a motor vehicle valve train is part of an internal combustion engine for a motor vehicle, not illustrated in greater detail. The internal combustion engine is part of a motor vehicle, not illustrated in greater detail, and has four cylinders, not illustrated in greater detail. The internal combustion engine is designed as a four-cylinder in-line engine. In principle, it is also conceivable for the internal combustion engine to have a different number of cylinders that appears meaningful to one skilled in the art. For each cylinder, the internal combustion engine has two valves, not illustrated in greater detail, which are designed as intake valves, and two valves, not illustrated in greater detail, which are designed as exhaust valves. In principle, it is also possible for the internal combustion engine to have only one intake valve and one exhaust valve for each cylinder, or some other number of intake and/or exhaust valves that appears meaningful to one skilled in the art. The device for adjusting a motor vehicle valve train has a camshaft 10*a*, designed as an intake camshaft, which activates the valves designed as intake valves, and a camshaft, not illustrated in greater detail, which is an exhaust camshaft and which activates the valves designed as exhaust valves. For reasons of clarity, only the camshaft 10*a* which is designed as an intake camshaft is described below. In principle, the camshaft designed as an exhaust camshaft may have essentially the same design as the intake camshaft 10*a* described below. The intake camshaft 10*a* and exhaust camshaft may act with different lifts on the valves which they activate; the lifts may differ in their maximum lift as well as in a lift characteristic. The camshaft 10*a* is rotatably supported in a cylinder head of the internal combustion engine.

The camshaft 10*a* includes four cam elements 11*a*, 12*a*, 13*a*, 14*a* arranged in an axially displaceable manner. The cam elements 11*a*, 12*a*, 13*a*, 14*a* are connected in a rotationally fixed manner to the camshaft 10*a* via a positive fit, not illustrated in greater detail. The cam elements 11*a*, 12*a*, 13*a*, 14*a* are displaceable between two switching positions in an axial direction extending parallel to an axis of rotation of the camshaft 10*a*. In principle, it is also conceivable for the cam elements 11*a*, 12*a*, 13*a*, 14*a* to be connected to the camshaft 10*a* in some other way that appears meaningful to one skilled in the art. The first cam element 11*a* is associated with the first cylinder and the corresponding valves. The second cam element 12*a* is associated with the second cylinder and the corresponding valves. The third cam element 13*a* is associated with the third cylinder and the corresponding valves. The fourth cam element 14*a* is associated with the fourth cylinder and the corresponding valves.

The axially displaceable cam elements 11*a*, 12*a*, 13*a*, 14*a* are provided for activating and adjusting a valve lift in each case of two valves of a cylinder. For this purpose, the cam elements 11*a*, 12*a*, 13*a*, 14*a* each have two cam tracks 24*a* for one valve in each case. Each of the cam elements 11*a*, 12*a*, 13*a*, 14*a* has two first cam tracks 24*a* and two second cam tracks 24*a*. One first cam track 24*a* and one second cam track 24*a* in each case are associated with the same valve of a cylinder, and have different valve lifts and lift characteristics. The first cam tracks 24*a* and the second cam tracks 24*a*, which in each case are associated with the same valve of the particular cylinder, are adjacently situated in each case on the respective cam element 11*a*, 12*a*, 13*a*, 14*a*. The first cam tracks 24*a* of the cam elements 11*a*, 12*a*, 13*a*, 14*a* are provided for a small valve lift. The second cam tracks 24*a* of the cam elements 11*a*, 12*a*, 13*a*, 14*a* are provided for a large valve lift. In a first switching position of the cam elements 11*a*, 12*a*, 13*a*, 14*a*, the first cam tracks 24*a* activate the corresponding valves. In a second switching position of the cam elements 11*a*, 12*a*, 13*a*, 14*a*, the second cam tracks 24*a* activate the corresponding valves. For adjusting a valve lift of the valves of a cylinder, the corresponding cam element 11*a*, 12*a*, 13*a*, 14*a* is switched from one switching position into the other switching position.

In each case two of the cam elements 11*a*, 12*a*, 13*a*, 14*a* which are adjacently situated are designed as a cam element group 17*a*, 18*a* to be switched together. The first cam element 11*a*, which is associated with the first cylinder, and the second cam element 12*a*, which is associated with the second cylinder, form the cam element group 17*a* to be switched together. The third cam element 13*a*, which is associated with the third cylinder, and the fourth cam element 14*a*, which is associated with the fourth cylinder, form the second cam element group 18*a* to be switched together. The cam elements 11*a*, 12*a*, 13*a*, 14*a* of one of the cam element groups 17*a*, 18*a* are in each case designed separate from one another as independent single components. The cam elements 11*a*, 12*a*, 13*a*, 14*a* of a cam element group 17*a*, 18*a* are in each case switched together during a switchover operation. Initially, in each case the first of the two cam elements 11*a*, 12*a*, 13*a*, 14*a* of a cam element group 17*a*, 18*a* is switched.

The two cam element groups 17*a*, 18*a* are switchable independently of one another. The first cam element group 17*a*, which is formed by the first cam element 11*a* and the second cam element 12*a*, is switchable independently from the second cam element group 18*a*, which is formed by the third cam element 13*a* and the fourth cam element 14*a*. A switching position of the first cam element 11*a* and of the second cam element 12*a*, which form the first cam element group 17*a*, may be changed regardless of whether the third cam element 13*a* and the fourth cam element 14*a*, which form the second cam element group 18*a*, are switched. The converse also applies. A switching position of the third cam element 13*a* and of the fourth cam element 14*a*, which form the second cam element group 18*a*, may be changed regardless of whether the first cam element 11*a* and the second cam element 12*a*, which form the first cam element group 17*a*, are switched. After a switchover operation, the cam elements 11*a*, 12*a*, 13*a*, 14*a* of a cam element group 17*a*, 18*a*, i.e., the first cam element 11*a* and the second cam element 12*a*, as well as the third cam element 13*a* and the fourth cam element 14*a*, in each case always have the same switching position.

The device for adjusting a motor vehicle valve train has two actuator devices 20*a*, 21*a*. One actuator device 20*a*, 21*a* is associated with one of the cam element groups 17*a*, 18*a*, respectively. The actuator devices 20*a*, 21*a* couple together the cam elements 11*a*, 12*a*, 13*a*, 14*a* of the cam element group 17*a*, 18*a* associated with them during a switchover operation. The first actuator device 20*a* is associated with the first cam element group 17*a*, and is provided for switching the first cam element 11*a* and the second cam element 12*a*. The second actuator device 21*a* is associated with the second cam element group 18*a*, and for this purpose is provided for switching the third cam element 13*a* and the fourth cam element 14*a*.

The first actuator device 20*a* and the second actuator device 21*a* have the same design. The first actuator device 20*a* has a schematically illustrated gate track 25*a*. A first portion of the gate track 25*a* is formed in one piece with the first cam element 11*a*, which is associated with the first cylinder. A second portion of the gate track 25*a* is formed in one piece with the second cam element 12*a*, which is associated with the second cylinder. The first and the second portions of the gate track 25*a* are circumferentially introduced into the first cam element 11*a* and the second cam element 12*a*, respectively. The first portion of the gate track 25*a* merges into the second portion of the gate track 25*a*. The second portion of the gate track 25*a* merges into the first portion of the gate track 25*a*. The actuator device 20*a* includes an actuator. The actuator includes a switching element designed as a switch pin. During a switchover operation, the switching element engages with the gate track 25*a* of the actuator device 20*a*. When the switchover operation starts, the switching element always initially engages with the first portion of the gate track 25*a*. As a result, the actuator device 20*a* initially switches the first cam element 11*a* from one switching position into the other switching position. If the switching element has come to the end of the first portion of the gate track 25*a*, the first cam element 11*a* is switched into the switching position to be switched, and the switching element enters the second portion of the gate track 25*a* and now switches the second cam element 12*a* into the switching position to be switched.

The second actuator device 21*a* likewise has a schematically illustrated gate track 25*a*. A first portion of the gate track 25*a* is formed in one piece with the third cam element 13*a*, which is associated with the third cylinder. A second portion of the gate track 25*a* is formed in one piece with the fourth cam element 14*a*, which is associated with the fourth cylinder. The first and the second portions of the gate track 25*a* are circumferentially introduced into the third cam element 13*a* and the fourth cam element 14*a*, respectively. The first portion of the gate track 25*a* merges into the second portion of the gate track 25*a*. The second portion of the gate track 25*a* merges into the first portion of the gate track 25*a*. The actuator device 21*a* includes an actuator. The actuator includes a switching element which is designed as a switch pin. During a switchover operation, the switching element engages with the gate track 25*a* of the actuator device 21*a*. When the switchover operation starts, the switching element always initially engages with the first portion of the gate track 25*a*. As a result, the actuator device 21*a* initially switches the third cam element 13*a* from one switching position into the other switching position. If the switching element has come to the end of the first portion of the gate track 25*a*, the third cam element 13*a* is switched into the switching position to be switched, and the switching element enters the second portion of the gate track 25*a* and now switches the fourth cam element 14*a* into the switching position to be switched.

The device for adjusting a motor vehicle valve train has a control and regulation unit 23*a*. The control and regulation unit 23*a* is provided for switching the first actuator device 20*a* and the second actuator device 21*a*. The cam elements 11*a*, 12*a* of the first cam element group 17*a* and the cam elements 13*a*, 14*a* of the second cam element group 18*a* may be switched via control by the control and regulation unit 23*a*. The control and regulation unit 23*a* is provided for operating, in at least one operating state, two cam elements 11*a*, 12*a*, 13*a*, 14*a* of one of the cam element groups 17*a*, 18*a* in a different switching position than two cam elements 11*a*, 12*a*, 13*a*, 14*a* of another of the cam element groups 17*a*, 18*a*. For this purpose, the control and regulation unit 23*a*, starting from an operating state in which all cam elements 11*a*, 12*a*, 13*a*, 14*a* are in the same switching position, switches by means of the appropriate actuator device 20*a*, 21*a* only the cam elements 11*a*, 12*a* of the first cam element group 17*a*, or only the cam elements 13*a*, 14*a* of the second cam element group 18*a*. The various cylinders of the internal combustion engine may thus be operated with different valve lifts, as the result of which different power levels may be generated. Thus, for example, it is conceivable for an internal combustion engine power of 100 kW to be composed of two different packets, for example a first packet of 70 kW from the first cylinder and the second cylinder, whose associated cam elements 11*a*, 12*a* are operated in a first switching position, and a second packet of 30 kW from the third cylinder and the fourth cylinder, whose associated cam elements 13*a*, 14*a* are operated in a second switching position. The 100 kW may thus be generated at a higher efficiency than when all cylinders are operated under the same load, i.e., when all cam elements 11*a*, 12*a*, 13*a*, 14*a* are operated in the same switching position.

The control and regulation unit 23*a* is provided for initially switching the cam element group 17*a*, 18*a* whose first cam element 11*a*, 13*a*, respectively, is the next to reach its base circle phase. A cam element 11*a*, 12*a*, 13*a*, 14*a* is in the base circle phase when the corresponding cam element 11*a*, 12*a*, 13*a*, 14*a* does not activate the valve associated with it. As a function of a point in time when a switchover operation of the cam elements is requested, the second cam element group 18*a* with its two cam elements 13*a*, 14*a* may initially be switched when, at the time of the request for the switchover operation, the third cam element 13*a* is the next to reach its base circle phase. When the first cam element 11*a* is the next to reach its base circle phase at the time of the request for the switchover operation, initially the cam elements 11*a*, 12*a* of the first cam element group 17*a* are switched.

The two cam element groups 17*a*, 18*a* activate the valves of the internal combustion engine, which is designed as a four-cylinder in-line engine. In principle, it is also conceivable for the two cam element groups 17*a*, 18*a* to be provided for activating valves of one line of an eight-cylinder V engine. One embodiment of the cam element groups 17*a*, 18*a* and of the actuator devices 20*a*, 21*a* for the line of an eight-cylinder V engine corresponds to the embodiment described here. For providing the device for adjusting a motor vehicle valve train for the entire eight-cylinder V engine, a further camshaft 10*a* having two additional cam element groups 17*a*, 18*a* and the corresponding actuator devices 20*a*, 21*a* is necessary.

FIG. 2 shows another exemplary embodiment of the invention. The following descriptions are limited essentially to the differences between the exemplary embodiments, wherein reference may be made to the description of the exemplary embodiment in FIG. 1 with regard to components, features, and functions which remain the same. For distinguishing the exemplary embodiments, the letter "a" in the reference numerals for the exemplary embodiment in FIG. 1 is replaced by the letter "b" in the reference numerals for the exemplary embodiment in FIG. 2. With regard to components denoted in the same way, in particular components having the same reference numerals, reference may basically also be made to the drawings and/or the description of the exemplary embodiment in FIG. 1.

FIG. 2 shows a device according to the invention for adjusting a motor vehicle valve train in a second exemplary embodiment. The device for adjusting a motor vehicle valve train is part of an internal combustion engine for a motor vehicle, not illustrated in greater detail. The internal combustion engine is part of a motor vehicle (not illustrated in greater detail) and, in contrast the first exemplary embodiment, has six cylinders (not illustrated in greater detail). The internal combustion engine is designed as a six-cylinder in-line engine.

The device for adjusting a motor vehicle valve train includes a camshaft 10*b*, which in contrast to the first exemplary embodiment includes six cam elements 11*b*, 12*b*, 13*b*, 14*b*, 15*b*, 16*b* arranged in an axially displaceable manner. The axially displaceable cam elements 11*b*, 12*b*, 13*b*, 14*b*, 15*b*, 16*b* are provided for activating and adjusting a valve lift in each case of two valves of a cylinder. In each case two of the cam elements 11*b*, 12*b*, 13*b*, 14*b*, 15*b*, 16*b* which are adjacently situated are designed as a cam element group 17*b*, 18*b*, 19*b* to be switched together. The first cam element 11*b*, which is associated with the first cylinder, and the second cam element 12*b*, which is associated with the second cylinder, form the cam element group 17*b* to be switched together. The third cam element 13*b*, which is associated with the third cylinder, and the fourth cam element 14*b*, which is associated with the fourth cylinder, form the second cam element group 18*b* to be switched together. The fifth cam element 15*b*, which is associated with the fifth cylinder, and the sixth cam element 16*b*, which is associated with the sixth cylinder, form the third cam element group 19*b* to be switched together. The three cam element groups 17*b*, 18*b*, 19*b* are switchable independently of one another. The device for adjusting a motor vehicle valve train has three actuator devices 20*b*, 21*b*, 22*b*. One actuator device 20*b*, 21*b*, 22*b* is associated with each of the cam element groups. All three actuator devices 20*b*, 21*b*, 22*b* have the same design, and correspond to the description for FIG. 1.

The three cam element groups 20*b*, 21*b*, 22*b* are provided for activating valves of the internal combustion engine designed as a six-cylinder in-line engine. In principle, it is also conceivable for the three cam element groups 20*b*, 21*b*, 22*b* to be provided for activating valves of one line of a twelve-cylinder V engine. One embodiment of the cam element groups 20*b*, 21*b*, 22*b* and of the actuator devices 20*b*, 21*b*, 22*b* for the line of a twelve-cylinder V engine corresponds to the embodiment described here. For providing the device for adjusting a motor vehicle valve train for the entire twelve-cylinder V engine, a further camshaft 10*b* having three additional cam element groups 20*b*, 21*b*, 22*b* and the corresponding actuator devices 20*b*, 21*b*, 22*b* is necessary.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMERALS

10 Camshaft
11 Cam element
12 Cam element
13 Cam element
14 Cam element
15 Cam element
16 Cam element
17 Cam element group
18 Cam element group
19 Cam element group
20 Actuator device
21 Actuator device
22 Actuator device
23 Control and/or regulation unit
24 Cam tracks
25 Gate track

The invention claimed is:

1. A device for adjusting a motor vehicle valve train comprising:

at least one camshaft with at least four cam elements arranged in an axially displaceable manner, wherein a first two adjacently arranged cam elements of the at least four cam elements are formed as a first cam element group and a second two adjacently arranged cam elements of the at least four cam elements are formed as a second cam element group, wherein the device is configured to switch the first two adjacently arranged cam elements of the first cam element group together and configured to switch the second two adjacently arranged cam elements of the second cam element group together, wherein the at least four cam elements are separate, independently formed components, wherein the device is configured to switch the first cam element group independently of the second cam element group such that switching of the second cam element group is uninfluenced by switching of the first cam element group.

2. The device of claim 1, further comprising:

a first actuator associated with the first cam element group and which couples the first two adjacently arranged cam elements to one another during a switchover operation; and a second actuator associated with the second cam element group and which couples the second two adjacently arranged cam elements to one another during a switchover operation.

3. The device of claim 1, wherein the first and second cam element groups are configured to activate valves of a four-cylinder in-line engine or of one line of an eight-cylinder V engine.

4. The device of claim 1, further comprising:

a third cam element group, wherein the first, second, and third cam element groups are configured to activate valves of a six-cylinder in-line engine or of one line of a twelve-cylinder V engine.

5. The device of claim 1, further comprising:

a control or regulation unit configured to operate, in at least one operating state, two cam elements of one of the first and second cam element groups in a different switching position than the two cam elements of another of the first and second cam element groups.

6. The device of claim 5, wherein in at least one operating state, the control or regulation unit is configured to initially switch a cam element group of the first and second cam element groups whose first cam element is a next one to reach its base circle phase.

7. An internal combustion engine, comprising:

a motor vehicle valve train having at least one camshaft with at least four cam elements arranged in an axially displaceable manner, wherein a first two adjacently arranged cam elements of the at least four cam elements are formed as a first cam element group and a second two adjacently arranged cam elements of the at least four cam elements are formed as a second cam element group, and wherein the at least four cam elements are separate, independently formed components; and a device configured to switch the first two adjacently arranged cam elements of the first cam element group together and configured to switch the second two adjacently arranged cam elements of the second cam element group together, wherein the device is configured to switch the first cam element group independently of the second cam element group such that switching of the second cam element group is uninfluenced by switching of the first cam element group.

8. The engine of claim 7, further comprising:

a first actuator associated with the first cam element group and which couples the first two adjacently arranged cam elements to one another during a switchover operation; and a second actuator associated with the second cam element group and which couples the second two adjacently arranged cam elements to one another during a switchover operation.

9. The engine of claim 7, wherein the first and second cam element groups are configured to activate valves of a four-cylinder in-line engine or of one line of an eight-cylinder V engine.

10. The engine of claim 7, further comprising:

a third cam element group, wherein the first, second, and third cam element groups are configured to activate valves of a six-cylinder in-line engine or of one line of a twelve-cylinder V engine.

11. The engine of claim 7, further comprising:

a control or regulation unit configured to operate, in at least one operating state, two cam elements of one of the first and second cam element groups in a different switching position than the two cam elements of another of the first and second cam element groups.

12. The engine of claim 11, wherein in at least one operating state, the control or regulation unit is configured to initially switch a cam element group of the first and second cam element groups whose first cam element is a next one to reach its base circle phase.

13. A method, comprising:

forming a first cam element group of a first two adjacently arranged cam elements of at least four cam elements arranged in an axially displaceable manner;

forming a second cam element group of a second two adjacently arranged cam elements of the at least four cam elements;

switching the first two adjacently arranged cam elements of the first cam element group together; and switching the second two adjacently arranged cam elements of the second cam element group together, wherein the at least four cam elements are separate, independently formed components, and wherein the switching of the first cam element group is independent of the switching of the second cam element group such that the switching of the second cam element group is uninfluenced by the switching of the first cam element group.

14. The method of claim 13, wherein in at least one operating state, two cam elements of one of the first and second cam element groups are operated in a different switching position than two cam elements of another of the first and second cam element groups.

* * * * *